US007931147B2

(12) United States Patent
Petrelli et al.

(10) Patent No.: US 7,931,147 B2
(45) Date of Patent: Apr. 26, 2011

(54) SELF STANDING AND ENVIRONMENTALLY SEPARABLE PACKAGE

(75) Inventors: J. Anthony Petrelli, Russell, OH (US); James J. Mattiucci, Wakefield, RI (US)

(73) Assignee: CardPak, Inc., Solon, OH (US)

( * ) Notice: Subject to any disclaimer, the term of this patent is extended or adjusted under 35 U.S.C. 154(b) by 39 days.

(21) Appl. No.: 12/431,225

(22) Filed: Apr. 28, 2009

(65) Prior Publication Data

US 2009/0272670 A1 Nov. 5, 2009

Related U.S. Application Data

(60) Provisional application No. 61/049,477, filed on May 1, 2008.

(51) Int. Cl.
*B65D 73/00* (2006.01)

(52) U.S. Cl. ..... 206/464; 206/461; 206/765; 206/764

(58) Field of Classification Search ..... 206/461, 206/462, 463, 464, 465, 764, 765, 45.25, 206/45.26, 467, 470, 471; 229/161, 163, 229/183, 184, 185

See application file for complete search history.

(56) References Cited

U.S. PATENT DOCUMENTS

| | | | | | |
|---|---|---|---|---|---|
| 2,993,590 | A * | 7/1961 | Denton | 206/469 |
| 3,127,010 | A * | 3/1964 | Capezzuto | 206/45.2 |
| 3,203,542 | A * | 8/1965 | Lightner et al. | 206/463 |
| 3,407,928 | A * | 10/1968 | Watts, Jr. | 206/463 |
| 3,685,649 | A * | 8/1972 | Diehl | 206/45.24 |
| 4,210,246 | A * | 7/1980 | Kuchenbecker | 206/461 |
| 4,549,654 | A * | 10/1985 | Tiesman | 206/486 |
| 4,702,368 | A * | 10/1987 | Jones | 206/45.24 |
| 4,784,268 | A | 11/1988 | Perchak | |
| 4,962,849 | A * | 10/1990 | Anderson | 206/45.24 |
| 5,301,800 | A * | 4/1994 | Kenney | 206/449 |
| D432,009 | S * | 10/2000 | Pirro et al. | D9/415 |
| 7,621,400 | B2 * | 11/2009 | Smith et al. | 206/470 |
| 2008/0217199 | A1 | 9/2008 | Burress | |

* cited by examiner

*Primary Examiner* — David T Fidei
(74) *Attorney, Agent, or Firm* — Roetzel & Andress

(57) ABSTRACT

The present invention generally relates to a package which allows a product to be displayed. In one embodiment, the package of the present invention can stand alone independently on an integrated cardboard base or can be hung from a bracket or shelf as a point of sale display. In another embodiment, the package of the present invention is able to be separated into its component parts so that such parts can be, if so required, independently recycled. In still another embodiment, due to its ability to be separated the package of the present invention can comprise various components formed from dissimilar materials (e.g., paper and plastic).

8 Claims, 6 Drawing Sheets

SELF STANDING AND ENVIRONMENTALLY SEPARABLE PACKAGE

RELATED APPLICATION DATA

This application claims priority to previously filed U.S. Provisional Patent Application No. 61/049,477, entitled "Self Standing and Environmentally Separable Package", and filed May 1, 2008, which is herein incorporated in its entirety by reference.

FIELD OF THE INVENTION

The present invention generally relates to a package which allows a product to be displayed. In one embodiment, the package of the present invention can stand alone independently on an integrated cardboard base or can be hung from a bracket or shelf as a point of sale display. In another embodiment, the package of the present invention is able to be separated into its component parts so that such parts can be, if so required, independently recycled. In still another embodiment, due to its ability to be separated the package of the present invention can comprise various components formed from dissimilar materials (e.g., paper and plastic).

BACKGROUND OF INVENTION

Blister or clam shell packages have long been used for packaging a wide variety of products and for displaying these products for sale in retail stores. The package is typically designed to conform to the configuration of the article contained therein. Such blisters/calm-shells, after filling, are bonded to supporting paper cards and can either be hung from a rack or if a stand-up type mechanism is utilized can be displayed on a shelf or table. Current stand up displays pose environmental recycling problems as typically the package is not completely separable/deconstructable. Typically, the bonding of the plastic to the card results in a plastic which is contaminated with paper/cardboard.

In recent years, the number and variety of products packaged and displayed in blister-type and clam shell type packaging has greatly increased. Part of this increase is due to the popularity of warehouse shopping centers. Such blister and clam-shell packages have found wide use in retail stores and warehouse centers as they display each item and also protect the product inside from tampering. As such, the displays should be pilfer-resistant, meaning one cannot easily shoplift, or steal, the product contained therein without first removing the item from the package or in the alternate by shoplifting the entire bulky package.

The hanging display, once predominantly used in the industry, has yielded portions of the market to alternative types of displays. The proliferation of warehouse stores/centers has required the use of a variety of standup displays. U.S. Pat. No. 4,784,268 details a standalone device which discloses a standard blister card on a shelf, eliminating the need for hanging the package. The patent discloses a stand-alone device which bonds plastic to a cardstock. The drawback to this setup is that this bonding/adhering between plastic and cardstock contaminates the plastic and thereby renders it unsuitable for a recycling process.

Co-pending U.S. Publication 2008/0217199 details a de-constructable package comprising: a front, a back, a base, and at least one insert, wherein the at least one insert has a top edge, a bottom edge, and at least one cavity, wherein the front, the back, the base and the at least one insert together form a de-constructable package, and wherein the combination of the base and the at least one insert permit the de-constructable package to stand independently. One advantage the present invention has over this prior art involves limitations in this application regarding the plastic base used. In the prior application, heavier products may cause the package to tip or may require additional plastic to stabilize. The present invention would allow the package retailer additional options in this regard, as options with the present invention's base would aid in the packaging of heavier and/or bulkier products.

In recent years, several major warehouse centers and retail outlets have undertaken environmentally friendly and/or green programs regarding recycling. These programs promote the use of environmentally friendly packaging and has necessitated the need for more environmentally friendly packaging designs. Thus, there is a need in the art for a package that not only has the ability stand independently, but also one that is more readily recycled.

SUMMARY OF INVENTION

The present invention generally relates to a package which allows a product to be displayed. In one embodiment, the package of the present invention can stand alone independently on an integrated cardboard base or can be hung from a bracket or shelf as a point of sale display. In another embodiment, the package of the present invention is able to be separated into its component parts so that such parts can be, if so required, independently recycled. In still another embodiment, due to its ability to be separated the package of the present invention can comprise various components formed from dissimilar materials (e.g., paper and plastic).

In one embodiment the present invention relates to a de-constructable package comprising a front, a back, a base, and at least one insert, wherein the at least one insert has a top edge, a bottom edge, and at least one cavity, wherein the front and the back are releasably joined to one another and along with the base and the at least one insert together form a de-constructable package, wherein the base is made from the same material as the front or back and permits the de-constructable package to stand independently, and the front, the back and the at least one insert are recyclable.

In another embodiment the present invention relates to a de-constructable package comprising a front, a back, a base, and at least one insert, wherein the at least one insert has a top edge, a bottom edge, and at least one cavity, wherein the front and the back are releasably joined to one another and along with the base and the at least one insert together form a de-constructable package, wherein the base is made from the same material as the front or back and permits the de-constructable package to stand independently, the front, the back and the at least one insert are recyclable and wherein the bottom edge of the at least one insert further comprises a first locking mechanism and wherein the base further comprises a second locking mechanism designed to operatively engage the first locking mechanism.

In still yet another embodiment the present invention relates to a method for forming a de-constructable package comprising providing at least one insert, wherein the at least one insert has a top edge, a bottom edge, and at least one cavity, providing a front with at least one opening and the at least one cavity protrudes through the at least one opening, providing a back, providing a base, securing the front, the back, the base and the at least one insert together to form a de-constructable package, wherein the base permits the de-constructable package to stand independently, wherein the front, the back, the base and the at least one insert are recyclable and the front and back are secured to one another with the at least one insert being releaseably located between the front and the back.

DETAILED DESCRIPTION OF THE INVENTION

Figure 1:
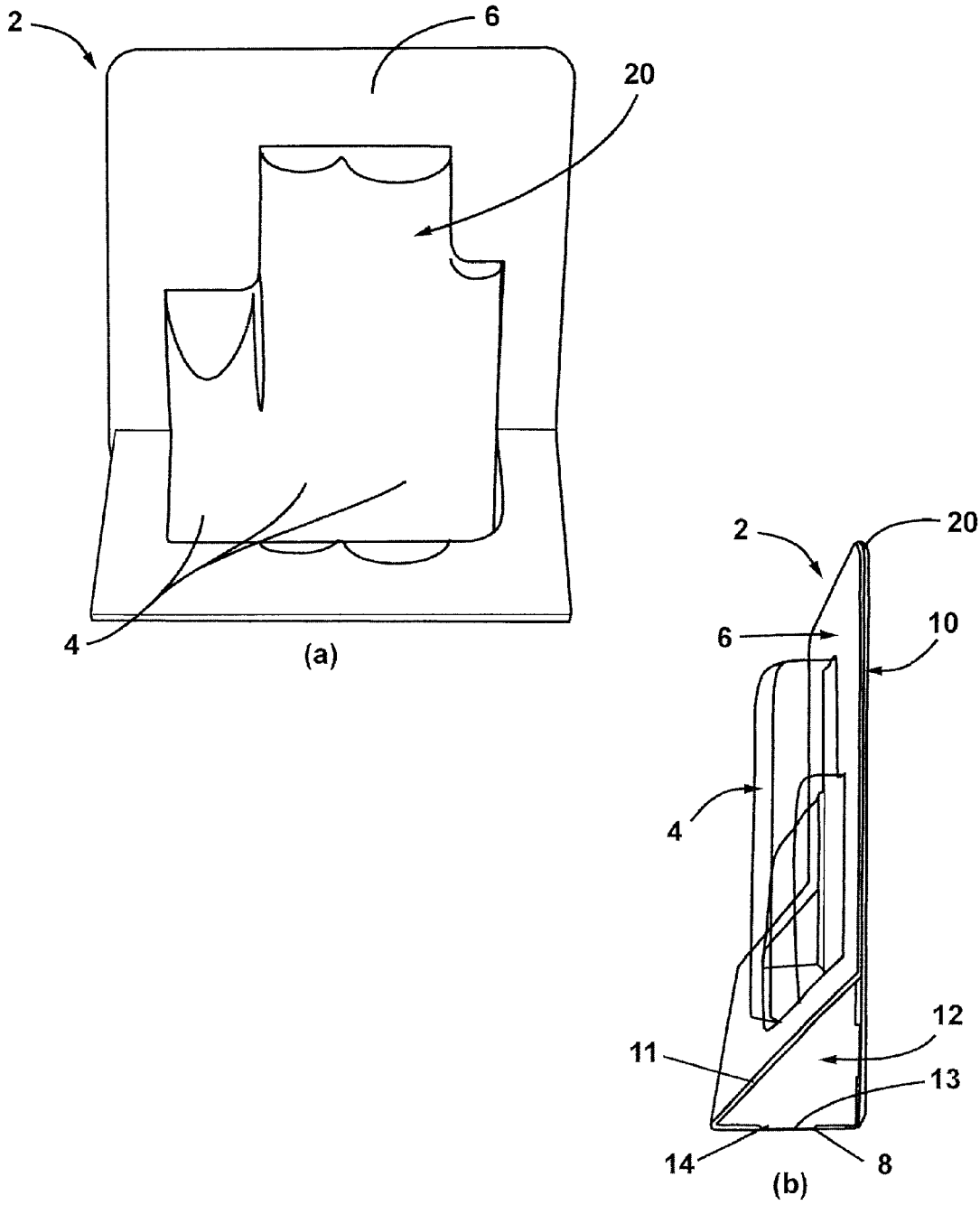
FIG. 1(*a*) is a front view of the package; (b) is a side view of the package.

The present invention generally relates to a package which allows a product to be displayed. In one embodiment, the package of the present invention can stand alone independently on an integrated cardboard base or can be hung from a bracket or shelf as a point of sale display. In another embodiment, the package of the present invention is able to be separated into its component parts so that such parts can be, if so required, independently recycled. In still another embodiment, due to its ability to be separated the package of the present invention can comprise various components formed from dissimilar materials (e.g., paper and plastic).

In one embodiment, the present invention provides a display package which can stand alone on a shelf, or table, or can be hung via a suitable bracket or holder. In another embodiment, the plastic and paper portions can be separated for recycling. In one embodiment the plastic and paper portions are not directly bonded to one another, thereby permitting easy separation of the two portions. In another embodiment the plastic and paper portions are compressed together, again allowing for separation of the two portions Another embodiment of a package in accordance with the present invention includes a plastic or paper insert located between at least two paper-based outer pieces such that the combination of the at least three pieces forms a package that can stand independently and is easily recyclable. In one instance, the paper-based pieces form a base located at the bottom of the package that creates an adequate stand to support the objects contained therein. Such a design may include an integrated cardboard portion which can be directly attached, adhered or be glued onto itself to create the base. In this instance, the avoidance of a direct seal between the plastic and the one or more paper-based pieces allows for greater flexibility in recycling. This embodiment allows for a design that avoids paper/fiber contamination as the sealing mechanism occurs between the paper cards and not between the plastic and the card. In still another embodiment the cardboard portions are made from one continuous piece of cardboard, allowing for ease in manufacturing and increasing the packages tamper resistance.

As used in the specification and claims, de-constructable is defined as a package that can be separated into suitable paper and plastic portions and then optionally be recycled via normal waste collection means. Recycleable is defined as a package recycled via normal waste collection means. Clamshell is a type of packaging design that is known to those of skill in the art. As used in conjunction with the present invention, suitable paper-based materials include, but are not limited to, paper, cardboard, cardstock, fluted card stock, fluted cardboard, corrugated card stock, fluted cardboard or any other product formed using paper/wood product as the starting material. Plastic or plastic-based materials suitable for use in conjunction with the present invention include, but are not limited to, products made from polymers. Examples of suitable plastic polymers include, but are not limited to, polypropylenes (PP), polystyrenes (PS), high impact polystyrenes (HIPS), polyethylene terephthalates (PET), polyvinyl chlorides (PVC), polyurethanes (PU), polycarbonates (PC), polyvinylidene chlorides (PVDC) and polyethylenes (PE). Due to the nature of product display, most embodiments will employ a transparent or translucent plastic.

In another embodiment any suitable biodegradable and/or compostable plastic can be used. An example would include, but is not limited to, Polycaprolactone (PCL).

In one embodiment, a stiffening card can be employed via the use of corrugated plastic, a corrugated paper, a plastic or a paper-based, insert. In one embodiment, a corrugated plastic insert is included in addition the plastic shell or inner portion. In another embodiment the profile or the blister flange itself is corrugated. This corrugated plastic allows for a substantially stiffer package and improves tamper resistance, appearance and stability. A similar corrugated paper-based insert may be used as well.

Examples of one embodiment of a self standing package are detailed in FIGS. 1 through 6. FIG. 1(*a*) details a front view of one embodiment used to display a product. Wilt FIG. 1(*b*) showing the side view. This embodiment is also detailed in FIGS. 3 and 5, where the embodiment is configured for men's shaving aids as the product. It should be noted that the present invention is not limited to just packaging for men's shaving aids as any type item, or number of items, can be placed within the confines of the package. In one embodiment, package 2 is comprised of a front 6, a middle 20, and a back 10. In one embodiment, front 2 and back 10 are formed from a paper-based material, while middle 20 is formed from a plastic-based material. As can be seen from FIG. 1, middle 20 contains a one or more product portions 4 that are formed to conform to and/or hold any suitable number of objects. In most embodiments, product portions 4 conforming to a size and shape larger than the product being contained.

Regarding front 6, in one embodiment front 6 has formed therein at least one opening that is designed to permit, if so desired, a portion, or portions, of middle 20 to protrude there through. In this case, middle 20 can also be referred to as an insert in package 2 because middle 20 can be "inserted" between front 6 and back 10. In still another embodiment, back 10 has formed therein at least one opening that is designed to permit, if so desired, a portion, or portions, of middle 20 to protrude there through.

In one embodiment, the material used to form middle 20 permits a user to visually observe the product contained therein. In this embodiment if visibility is desired, middle 20 is formed from a clear plastic, or plastic-based, material. However, middle 20 of the present invention does not always need to be formed from a translucent, clear, or optically clear plastic material. In some instances, it is desirable to have a middle 20 formed from an opaque material. The opaque material can be formed by any number of methods known in the art. In addition, the plastic used is of an adequate thickness to prevent tampering and/or pilfering of product. It is understood that the particular design of product portions 4 depends upon the contents destined to be contained, or cradled therein.

In one embodiment the product portions conforming to the product shape so as to minimize movement of the product within package 2 and specifically within product portion 4.

FIG. 1 also details front 6. In one embodiment front 6 may be decorative and used as a suitable manner of advertising, or providing information about, the product contained therein. As one of skill in the art would appreciate, this concept is not limited to any one single advertising embodiment as an unlimited number of embodiments are possible to produce various packaging designs. Front 6 can be made from any of the paper-based materials detailed above. In one embodiment, front 6 is formed from paper, cardboard, or even a plastic or plastic-based material. In still another embodiment, the paper-based materials used in the packaging of the present invention contain at least some amount of recycled paper material. In yet another embodiment, the plastic-based materials used in the packaging of the present invention contain at least some amount of recycled plastic material.

Additionally, front 6 can be made from a material which can be sealed to one or more cards on at least one side (i.e. card front can be made from several layers of cardstock, with an advertisement typically being on the outermost or top layer). The side for this adhesion/sealing of front 6 is not shown in FIG. 1(*a*) and can be seen only from the side in FIG. 1(*b*) (and also FIGS. 5 and 6). The non-advertisement containing side is typically used for sealing and is, in this example, the back (or second surface) of front 6. Front 6 may contain one or more optional holes or voids at or near the top of the package to allow the package to be hung from a display.

Figure 2:
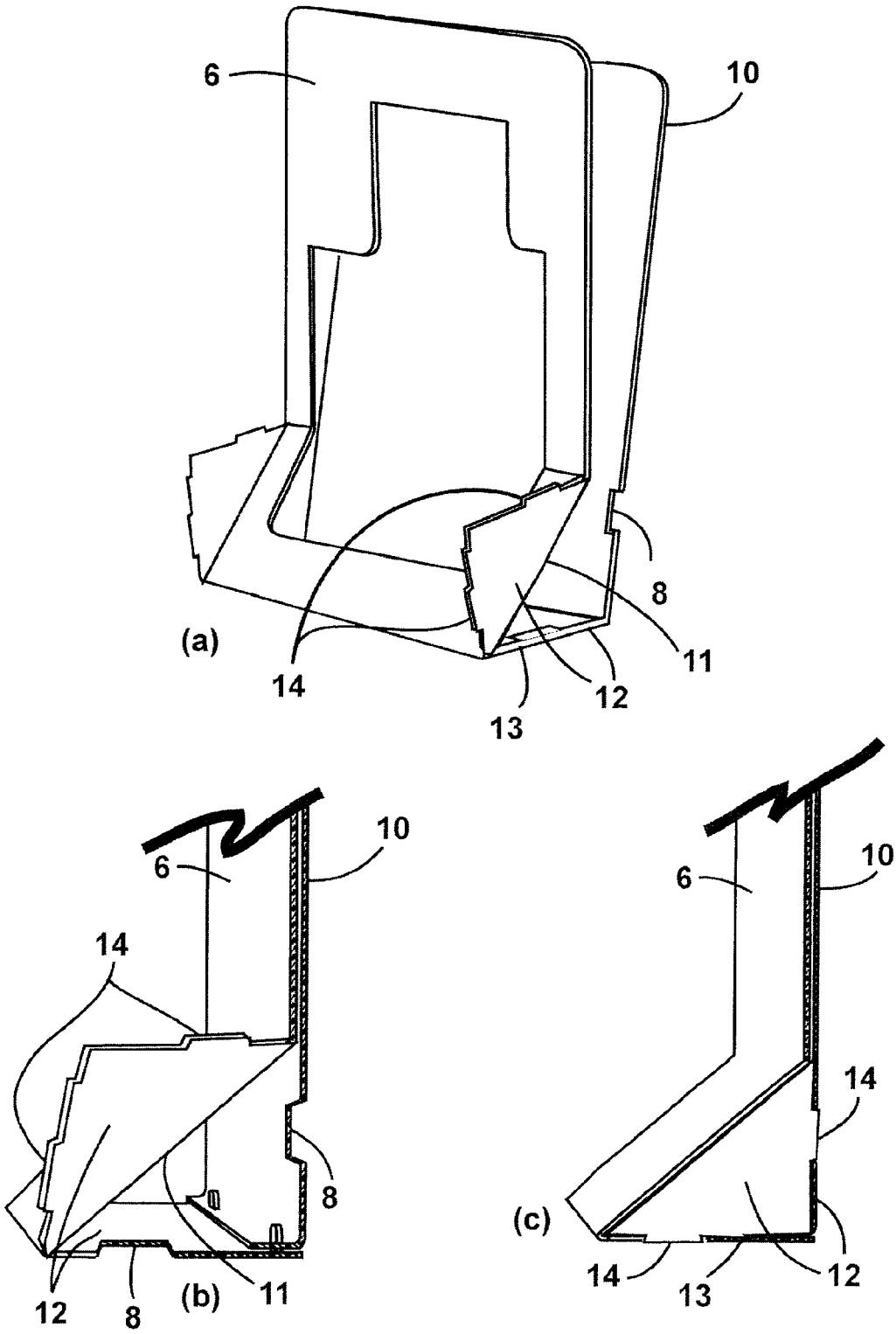
FIG. 2(*a*) is an exploded view of the package; (b) is a close-up view of the base with flap opened and the underside or middle exposed; and (c) is a close-up view of the base with the flap closed.

FIG. 2 provides a drawing of the package without middle 20. In addition, FIG. 2 provides a view of the base 12 in various states of assembly. FIG. 2(*a*) shows an exploded view of front 6 and back 10 prior to assembly and prior to insertion of middle 20.

FIGS. 2(*b*) and 2(*c*) provide a profile view of one embodiment of base 12 of package 2. Base 12 providing adequate support for vertically displaying package 2 on a shelf, table or in a sleeved box. Base 12 providing a stable support and allowing package 2 to stand independently. Base 12 is formed so that base 12 bottom is typically at or near a 90 degree angle to back 10 and forms a stable means. In one embodiment the front or angled portion 11 of base 12 is formed at an angle between about 100 and about 170 degrees to front 6. The size of base 12, and in particular the size of the bottom 13 of base 12 being dependent on the support required for package 2.

In another embodiment base 12 is a rectangular base with the bottom of base 12 typically at or near a 90 degree angle in relation to back 10. This forms a stable platform that permits package 2 to be stood up. In still yet another embodiment base 12 employs a circular structure in forming base 12. In still another embodiment, base 12 can be any suitable shape, including, but not limited to, a regular polygon shape.

In one embodiment base 12 secures to or locks onto back 10. This locking of base 12 to back 10 includes but is not limited to tabs, adhesion, pressure adhesion, inserts or perforations. The size of the base 12 varies due to the product used and the product portions 4 desired. In various embodiments, packages 2 displaying products requiring various width bases, various height bases or various depth bases. As stated previous, base 12 being dependent on package 2 and product requirements. Finally, while a triangular base 12 is detailed in FIG. 2, the exact shape of base 12 may vary. The shape of base 12 may be altered due to aesthetic or functional factors. In still another embodiment base 12 locks onto front 6 via similar means.

In one embodiment base 12 is formed from the same piece of material as back 10 and front 6. In this embodiment back 10, front 6, and base 12 are manufactured from one single, continuous piece of material. In yet another embodiment base 12 is formed from the same piece of material as front 6. In this embodiment front 6, and base 12 are manufactured from one single, continuous piece of material and subsequently adhered to back 10.

In one embodiment in order to form and secure base 12, base tab(s) 14 are utilized. As shown in FIG. 2, base tab(s) 14 are designed to reside in base receptacle 8. Base tab 14 being designed in a manner that allows attachment or securing to base receptacle 8, yet provide enough maneuverability and pliability to easily remove the product by deconstructing base 12. In one embodiment base tab(s) 14 are from the same continuous piece of materials as front 6 and base 12.

FIG. 1 (and FIG. 2, minus middle 20) further details front 6, back 10, and middle 20 and the layered aspects thereof. In a standard use such as in a retail store, these three layers are adhered/affixed/bonded to one another. In one embodiment, front 6 is secured directly to back 10 via a securing means such as, but not limited to glue, adhesive, heat activated adhesive, pressure activated adhesive, releaseable adhesive, or pressure. Releaseable adhesive is defined as an adhesive means which releases, leaving behind minimal traces of the adhesive upon one surface. Suitable releasable adhesives include, but are not limited to, acrylate-copolymer microsphere formulations, like those utilized on Post-It® Notes. Such adhesives are known to those of skill in the art and a detailed discussion herein is omitted for the sake of brevity.

In one embodiment, the outermost edges of front 6 and back 10 are approximately the same size and shape to allow package 2 to maintain a neat and professional appearance. A blister flange can be found on the outer edges of middle 20. Blister flange being a flat and continuous part of middle 20 and used to adhere and secure middle 20. Front 6 and back 10 are both slightly larger than the outermost edges of blister flange. This setup allowing a proper seal between front 6 and back 10 and adequately securing blister flange. In such an embodiment front 6 and back 10 adhere to one another at the edges, essentially securing blister flange in between front 6 and back 10 and ultimately securing middle 20.

In one embodiment back 10 contains a series of cutouts. Such a series of cutouts can be, but are not limited to perforations in the cardboard to allow a complete or partial detachment of the cutout portion of the cardboard. Such a cutout allowing for removal of one or more of the products contained therein. In another embodiment product portions 4 or middle 20 may include perforations in the plastic to allow a complete or partial detachment of the cutout portion of the plastic.

FIG. 2 details the locking or securing aspect described previous in base 12, as base tab(s) 14 are designed to reside in base receptacle 8. The exact location of base tab(s) 14 designed to reside in base receptacle 8 can be altered, reversed or moved according the product being displayed/sold. In one embodiment base 12 attaches or locks itself near the bottom of back 10. Various embodiments are possible which utilize different locking mechanisms that allow a proper securing. Examples include, but are not limited to, the triangle shown, a rectangle, a circle, a semi circle or any combination thereof. The locking mechanism may vary and take different forms based on the needs and requirements of the individual user. The ultimate purpose of the locking mechanism being to secure or close the package to allow display in a vertical manner. FIG. 1(*b*), FIG. 2(*c*), FIG. 5 and FIG. 6 detail the package with base 12 secured and creating a bottom edge 13 allowing the package to stand independently.

In one embodiment package 2 contains two significant parts, the card stock referred to as front 6 and back 10 and the middle 20. Middle 20 including both the blister flange portion and the product portions 4. In one embodiment front 6 is directly bonded to back 10. This arrangement essentially locks in or secures blister flange.

In another embodiment front 6 is able to seal at one or more points to back 10. This sealing being a glue, an adhesive, a heat activated adhesive, a pressure activated adhesive, pressure or any other suitable adhering means.

Figure 3:
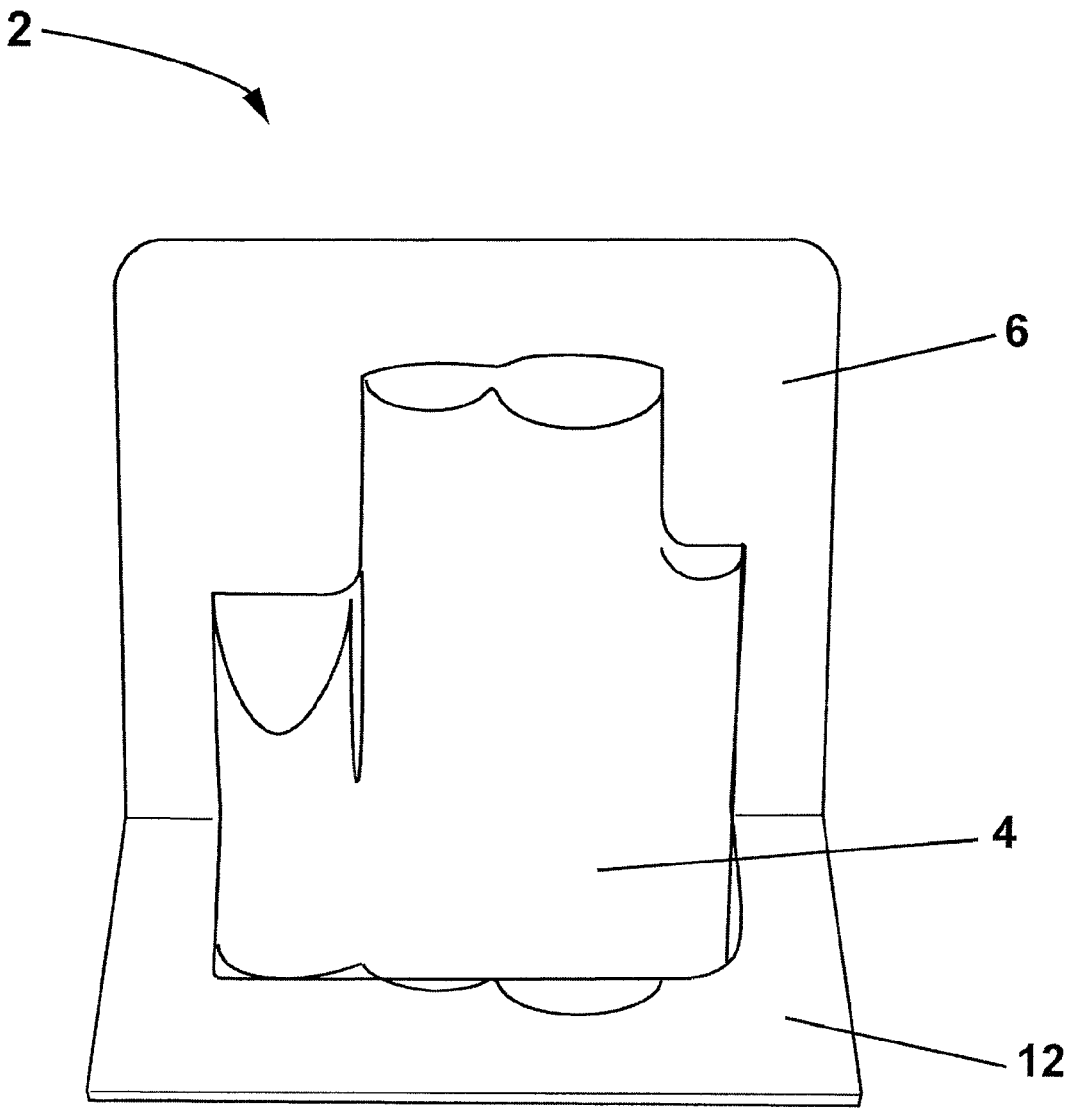
FIG. 3 is a front drawing of one embodiment of the package.
Figure 4:
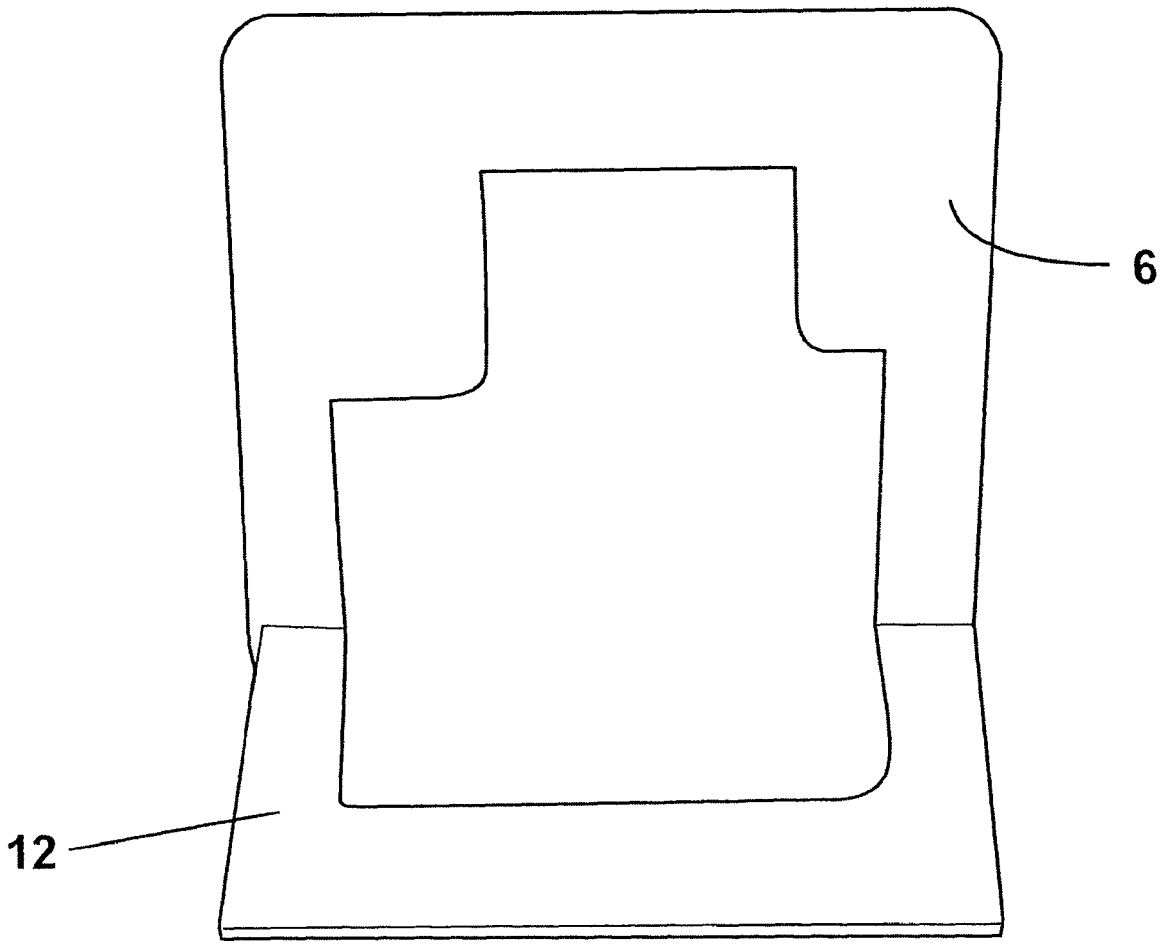
FIG. 4 is a front drawing of one embodiment of the package with the plastic portion removed.
Figure 5:
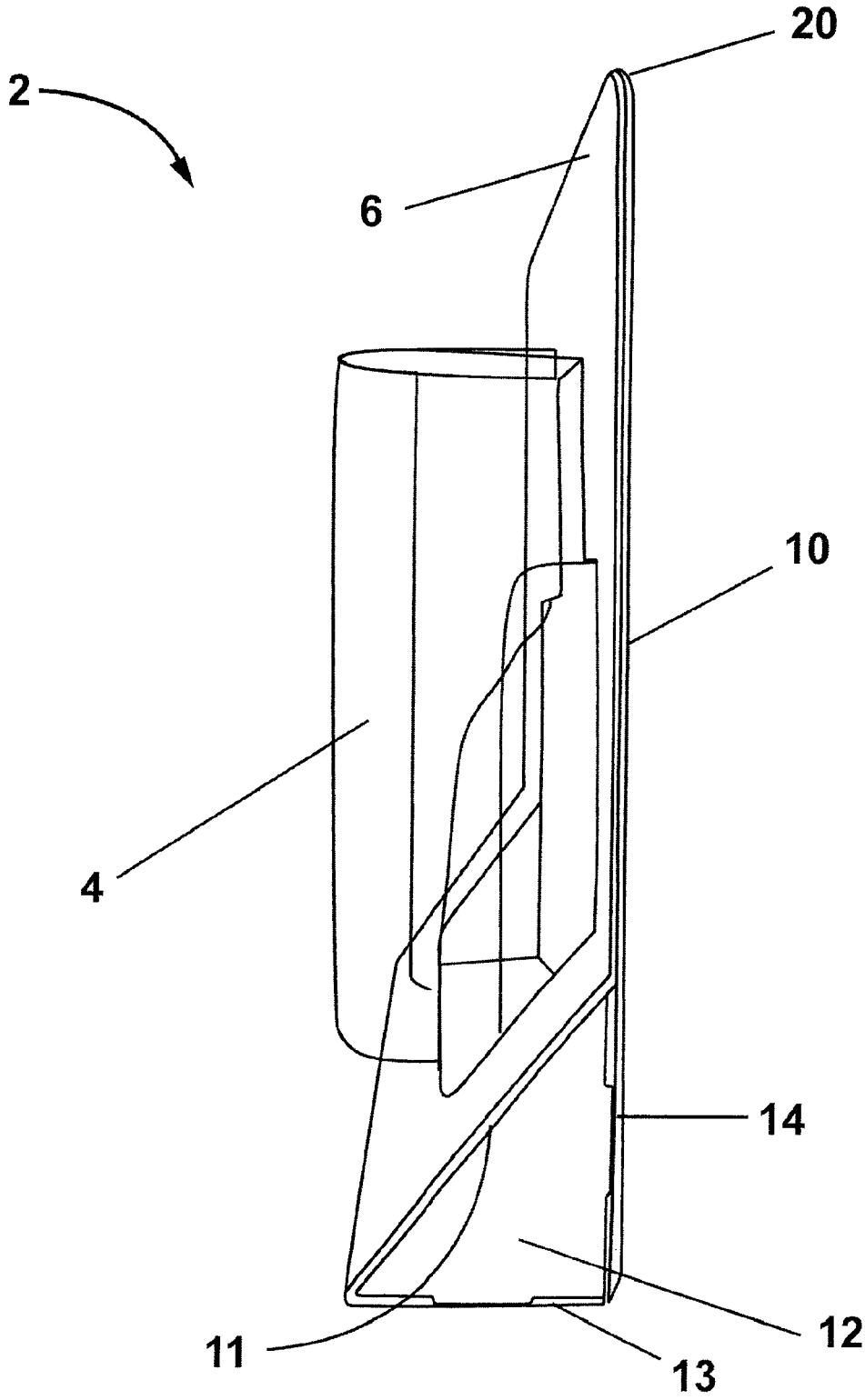
FIG. 5 is a side drawing of one embodiment of the package.
Figure 6:
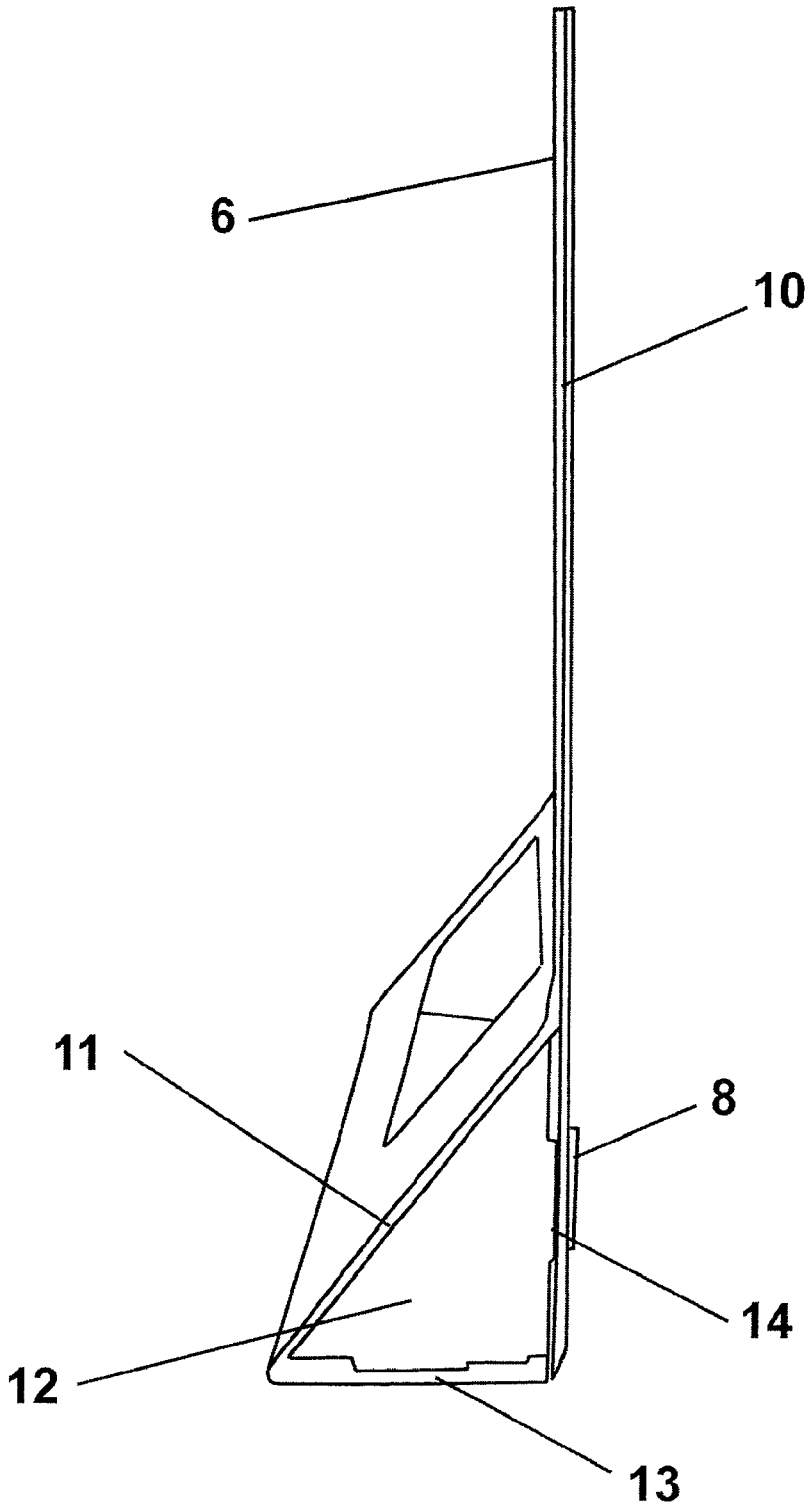
FIG. 6 is a side drawing of one embodiment of the package with the plastic portion removed.

As shown in FIG. 1, FIG. 3 and FIG. 5, middle 20 can be removed from a plastic forming mold as one continuous piece. The entire middle 20 being designed as one flat piece with product portions 4 being formed out of that piece. In one embodiment once placed between front 6 and back 10, middle 20 can optionally bend into a second plane needed to effect to strengthen base 12 features of package 2. In one embodiment base 12 rotates from the original orientation in middle 20 plane to a 90-degree angle from its original orientation. This allows base 12 to provide support to package 2 and stand in an upright manner. Additional embodiments can employ a angles of 0° to 180° and may employ various starting dimensions which provide a lateral base 12 to display package 2 in a vertical plane. Middle 20 can optionally employ angles of 0° to 180° to further enhance stiffening of base 12. Typically these angle occur below product portion 4 and are located within base 12.

In order to increase the stiffness of package 2, a corrugated insert may be used. This corrugated insert may be formed from plastic, paper or cardboard. In one embodiment, a corrugated plastic insert providing substantial strength/stiffening to front 6 and back 10. The corrugated plastic insert also providing additional tamper and pilfer resistance aspects to package 2. The corrugated aspects of corrugated plastic insert can be, but are not limited to a series of ribs which are semi-circular, a triangular aspect, a rectangular aspect, a cross hatched pattern, a fluted aspect, or any other suitable arrangement which adds stiffness/strength to this area. In one embodiment, the corrugated portion runs to plastic insert edges. Corrugated plastic insert can be included as a separate insert or can incorporate the corrugated aspects into blister flange. Such a one piece corrugated plastic insert being incorporated into the molding process of middle 20, including specifically blister flange 16 provide a one piece plastic product providing the beneficial aspects of both corrugated plastic insert and blister flange. In another embodiment a corrugated paper insert may be used. Corrugated paper insert providing substantial strength/stiffening to front 6 and back 10.

Embodiments needing additional vertical support benefit from the strength corrugated inserts provide, this being especially important for allowing additional support to allow a product to stand independently. Embodiments needing additional tamper or pilfer resistance may also benefit from the tear resistance aspects corrugated plastic inserts provide. In one embodiment, corrugated plastic insert being slightly smaller than the dimension of front 6 and back 10, allowing for proper sealing between card front 6 and card back 10. As stated previous the use of void spaces is also possible to effectuate proper adhesion. Finally, the use of corrugated plastic inserts allowing for complete recycling of the paper portions and plastic portions of package 2.

The size aspects of the middle 20 and/or the corrugated plastic insert or any combination thereof are important. In order to properly place product 8 these inserts/portions must be properly sized. One such embodiment involves using a middle 20 and/or corrugated plastic insert which are nearly the same size as front 6 and back 10, with middle 20 and/or corrugated plastic insert being slightly smaller to allow a seal between front 6 and back 10. Using a middle 20 and/or a corrugated plastic insert nearly the same size as front 6 and back 10 allows for optimal product placement as product has less ability to move around as product portions 4 are properly positioned between the at least two cards. Middle 20 and/or corrugated plastic insert providing additional tamper resistance and reducing potential pilfering of the package.

One advantage to using middle 20 and/or the corrugated plastic insert involves the elimination of a cardboard stiffener. In instances where a cardboard stiffener is used, one can now utilize these stiffening aspects into either middle 20 or by using corrugated plastic insert, and thereby one or more components is removed from processing.

Although some of the features and concepts of the invention have been described in detail with particular reference to certain embodiments detailed herein, other embodiments which are within the scope of the invention can achieve the same results. Variations and modifications of the present invention which may be made by those skilled in the art are within the scope of the invention as defined by the claims and equivalents thereof.

What is claimed is:

1. A de-constructable package comprising:

a front;

a back;

a base; and at least one insert, wherein the at least one insert has a top edge, a bottom edge, and at least one cavity, wherein the front further comprises at least two flexible portions that are integrally formed on opposites sides of the front, the at least two flexible portions comprising one or more base tabs that engage at least the back and/or the base, wherein the front and the back are releasably joined to one another and along with the base and the at least one insert together form a de-constructable package, wherein the base is made from the same material as the front or back and permits the de-constructable package to stand independently, and wherein the front, the back and the at least one insert are recyclable.

2. The de-constructable package of claim 1, wherein the at least one insert is releasably located between the front and the back.

3. The de-constructable package of claim 1, wherein the front has at least one opening and the at least one cavity protrudes through the at least one opening.

4. The de-constructable package of claim 1, wherein the back further comprises at least one opening there through and the at least one cavity protrudes through the at least one opening.

5. The de-constructable package of claim 1, wherein the front is releasably directly secured to the back with the at least one insert being releasably located between the front and the back.

6. The de-constructable package of claim 1, wherein the front and back are made from a paper-based material and the at least one insert is made from a plastic-based material.

7. The de-constructable package of claim 1, wherein the at least one insert is fluted or corrugated.

8. The de-constructable package of claim 1, wherein the front, the back and the at least one insert are attached via an adhesive.

* * * * *